United States Patent [19]

Swan et al.

[11] Patent Number: 4,965,011

[45] Date of Patent: Oct. 23, 1990

[54] AZEOTROPE-LIKE COMPOSITIONS OF 1,1-DICHLORO-1-FLUOROETHANE, DICHLOROTRIFLUOROETHANE, AND NITROMETHANE

[75] Inventors: Ellen L. Swan, Ransomville; Rajat S. Basu, Williamsville, both of N.Y.; Joel E. Rodgers, Convent Station, N.J.

[73] Assignee: Allied-Signal Inc., Morristown, N.J.

[21] Appl. No.: 417,134

[22] Filed: Oct. 4, 1989

[51] Int. Cl.[5] ..... C11D 7/30; C11D 7/50

[52] U.S. Cl. ..... 252/171; 252/162; 252/170; 252/172; 252/DIG. 9; 252/364; 134/12; 134/38; 134/39; 134/40

[58] Field of Search ..... 252/364, 162, 170, 171, 252/172, DIG. 9; 134/12, 38, 39, 40

[56] References Cited

U.S. PATENT DOCUMENTS 4,863,630 9/1989 Swan ..... 252/171

FOREIGN PATENT DOCUMENTS 1103686 4/1989 Japan .
1136981 5/1989 Japan .
1136982 5/1989 Japan .
1137253 5/1989 Japan .
1137259 5/1989 Japan .
1138300 5/1989 Japan .
1139539 6/1989 Japan .
1139861 6/1989 Japan .

*Primary Examiner*—Prince E. Willis
*Assistant Examiner*—Kathleen Markowski
*Attorney, Agent, or Firm*—Melanie L. Brown; Jay P. Friedenson

[57] ABSTRACT

Azeotrope-like compositions comprising 1,1-dichloro-1-fluoroethane, dichlorotrifluoroethane, and nitromethane are stable and have utility as solvents in a variety of industrial cleaning applications including cold cleaning and defluxing of printed circuit boards.

20 Claims, No Drawings

AZEOTROPE-LIKE COMPOSITIONS OF 1,1-DICHLORO-1-FLUOROETHANE, DICHLOROTRIFLUOROETHANE, AND NITROMETHANE

FIELD OF THE INVENTION

This invention relates to azeotrope-like or essentially constant boiling mixtures of 1,1-dichloro-1-fluoroethane, dichlorotrifluoroethane, and nitromethane. These mixtures are useful in a variety of vapor degreasing, cold cleaning and solvent cleaning applications including defluxing.

CROSS-REFERENCE TO RELATED APPLICATIONS

Co-pending, commonly assigned application Ser. No. 297,467, filed Jan. 17, 1989 which is a continuation-in-part application of Ser. No. 290,124, filed Dec. 27, 1988, discloses azeotrope-like mixtures of 1,1-dichloro-l-fluoroethane, dichlorotrifluoroethane, and methanol.

Co-pending, commonly assigned application Ser. No. 330,252, filed Mar. 29, 1989, discloses azeotrope-like mixtures of 1,1-dichloro-1-fluoroethane, dichlorotrifluoroethane, and ethanol.

Co-pending, commonly assigned application Ser. No. 345,732, filed May, 1, 1989, discloses azeotrope-like mix tures of 1,1-dichloro-1-fluoroethane, dichlorotrifluoroethane, nitromethane, and methanol or ethanol.

Co-pending, commonly assigned application Serial No. 362,294, filed Jun. 6, 1989, discloses azeotrope-like dichlorotrifluoroethane.

BACKGROUND OF THE INVENTION

Vapor degreasing and solvent cleaning with fluorocarbon based solvents have found widespread use in industry for the degreasing and otherwise cleaning of solid surfaces, especially intricate parts and difficult to remove soils.

In its simplest form, vapor degreasing or solvent cleaning consists of exposing a room temperature object to be cleaned to the vapors of a boiling solvent. Vapors condensing on the object provide clean distilled solvent to wash away grease or other contamination. Final evaporation of solvent from the object leaves behind no residue as would be the case where the object is simply washed in liquid solvent.

For difficult to remove soils where elevated temperature is necessary to improve the cleaning action of the solvent, or for large volume assembly line operations where the cleaning of metal parts and assemblies must be done efficiently and quickly, the conventional operation of a vapor degreaser consists of immersing the part to be cleaned in a sump of boiling solvent which removes the bulk of the soil, thereafter immersing the part in a sump containing freshly distilled solvent near room temperature, and finally exposing the part to solvent vapors over the boiling sump which condense on the cleaned part. In addition, the part can also be sprayed with distilled solvent before final rinsing.

Vapor degreasers suitable in the above-described operations are well known in the art. For example, Sherliker et al. in U.S. pat. No. 3,085,918 disclose such suitable vapor degreasers comprising a boiling sump, a clean sump, a water separator, and other ancillary equipment.

Cold cleaning is another application where a number of solvents are used. In most cold cleaning applications, the soiled part is either immersed in the fluid or wiped with rags or similar objects soaked in solvents and allowed to air dry.

Fluorocarbon solvents, such as trichlorotrifluoroethane, have attained widespread use in recent years as effective, nontoxic and nonflammable aqents useful in deqreasinq applications and other solvent cleaning applications. Trichlorotrifluoroethane has been found to have satisfactory solvent power for greases, oils, waxes and the like. It has therefore found widespread use for cleaning electric motors, compressors heavy metal parts, delicate precision metal parts, printed circuit boards, gyroscopes, guidance systems, aerospace and missile hardware, aluminum parts and the like.

The art has looked towards azeotrope or azeotrope-like compositions including the desired fluorocarbon components such as trichlorotrifluoroethane which include components which contribute additionally desired characteristics, such as polar functionality, increased solvency power, and stabilizers. Azeotropic or azeotrope-like compositions are desired because they do not fractionate upon boiling. This behavior is desirable because in the previously described vapor degreasing equipment with which these solvents are employed. redistilled material is generated for final rinse-cleaning. Thus, the vapor degreasing system acts as a still. Unless the solvent composition exhibits a constant boiling point, i.e., is azeotrope-like, fractionation will occur and undesirable solvent distribution may act to upset the cleaning and safety of processing. Preferential evaporation of the more volatile components of the solvent mixtures,. which would be the case if they were not azeotrope-like, would result in mixtures with changed compositions which may have less desirable properties, such as lower solvency towards soils, less inertness towards metal, plastic or elastomer components, and increased flammability and toxicity.

The art is continually seeking new fluorocarbon based azeotrope-like mixtures which offer alternatives for new and special applications for vapor degreasing and other cleaning applications. Currently, of particular interest, are fluorocarbon based azeotrope-like mixtures which are considered to be stratospherically safe substitutes for presently used fully halogenated chlorofluorocarbons. The latter are suspected of causing environmental problems in connection with the earth's protective ozone layer. Mathematical models have substantiated that hydrochlorofluorocarbons such as 1,1-dichloro-1-fluoroethane (HCFC-141b) and dichlorotrifluoroethane (HCFC-123 or HCFC-123a). will not adversely affect atmospheric chemistry, being negligible contributors to ozone depletion and to green-house global warming in comparison to the fully halogenated species.

It is an object of this invention to provide novel azeotrope-like compositions based on HCFC-141b and dichlorotrifluoroethane which are liquid at room temperature, which will not fractionate substantially under the process of distillation or evaporation, and which are useful as solvents for use in vapor degreasing and other solvent cleaning applications including defluxing applications.

Another object of the invention is to provide novel environmentally acceptable solvents for use in the aforementioned applications.

Other objects and advantages of the invention will become apparent from the following description.

DESCRIPTION OF THE INVENTION

In accordance with the invention, novel azeotrope-like or constant-boiling compositions have been discovered comprising 1,1-dichloro-1-fluoroethane; dichlorotrifluoroethane; and nitromethane. The dichlorotrifluoroethane component can be one of its isomers: 1,1-dichloro-2,2,2-trifluoroethane (HCFC-123); 1,2-dichloro-1,2,2-trifluoroethane (HCFC-123a); or mixtures thereof in any proportions.

The preferred isomer of the dichlorotrifluoroethane component is HCFC-123. The preferred HCFC-123 is "commercial HCFC-123" which is available as "pure" HCFC-123 containing about 90 to about 95 weight percent of HCFC-123. about 5 to about 10 weight percent of HCFC-123a, and impurities such as trichloromonofluoromethane. trichlorotrifluoroethane, and methylene chloride which due to their presence in insignificant amounts, have no deleterious effects on the properties of the azeotrope-like compositions. "Commercial HCFC-123" is also available as "ultra-pure" HCFC-123 which contains about 95 to about 99.5 weight percent of HCFC-123, about 0.5 to about 5 weight percent of HCFC-123a, and impurities as listed above.

When the dichlorotrifluoroethane used is 1,1-dichloro-2,2,2-trifluoroethane, the novel azeotrope-like compositions comprise 1,1-dichloro-1-fluoroethane; 1,1-dichloro-2,2,2-trifluoroethane; and nitromethane which boil at about 31.8° C. ±about 0.8° C. at 760 mm Hg (101 kpa).

More specifically, novel azeotrope-like compositions comprise from about 25 to about 99.5 weight percent of 1,1-dichloro-1-fluoroethane, from about 0.5 to about 74.5 weight percent of 1,1-dichloro-2,2,2-trifluoroethane, and from about 0.01 to about 0.5 weight percent of nitromethane which boil at about 31.8° C. at 760 mm Hg (101 kpa).

Preferably, the azeotrope-like compositions of the invention comprise from about 50 to about 99.5 weight percent of 1,1-dichloro-1-fluoroethane, from about 0.5 to about 49.5 weight percent of 1,1-dichloro-2,2,2-trifluoroethane, and from about 0.01 to about 0.5 weight percent nitromethane.

More preferably, the azeotrope-like compositions of the invention comprise from about 60 to about 99.5 weight percent of 1,1-dichloro-1-fluoroethane, from about 0.5 to about 39.5 weight percent of 1,1-dichloro-2,2,2-trifluoroethane, and from about 0.01 to about 0.5 weight percent nitromethane.

Even more preferably, the azeotrope-like compositions of the invention comprise from about 65 to about 99.5 weight percent of 1,1-dichloro-1-fluoroethane, from about 0.5 to about 34.5 weight percent of 1,1-dichloro-2,2,2-trifluoroethane, and from about 0.01 to about 0.5 weight percent nitromethane.

Most preferably, the azeotrope-like compositions of the invention comprise from about 85 to about 99.5 weight percent of 1,1-dichloro-1-fluoroethane, from about 0.5 to about 14.7 weight percent of 1,1-dichloro-2,2,2-trifluoroethane, and from about 0.01 to about 0.3 weight percent of nitromethane.

When the dichlorotrifluoroethane used is 1,2-dichloro-1,2,2-trifluoroethane, novel azeotrope-like compositions comprise 1,1-dichloro-1-fluoroethane; 1,2-dichloro-1,2,2-trifluoroethane; and nitromethane which boil at about 32.0° C.±about 0.7° C. at 760 mm Hg (101 kpa).

More specifically, novel azeotrope-like compositions comprise from about 25 to about 99.5 weight percent of 1,1-dichloro-1-fluoroethane, from about 0.5 to about 74.5 weight percent of 1,2-dichloro-1,2,2-trifluoroethane, and from about 0.01 to about 0.5 weight percent of nitromethane which boil at about 32.0° C. at 760 mm Hg (101 kpa).

preferably, the azeotrope-like compositions of the invention comprise from about 50 to about 99.5 weight percent of 1,1-dichloro-1-fluoroethane, from about 0.5 to about 49.5 weight percent of 1,2-dichloro-1,2,2-trifluoroethane, and from about 0.1 to about 0.5 weight percent nitromethane.

More preferably, the azeotrope-like compositions of the invention comprise from about 60 to about 99.5 weight percent of 1,1-dichloro-1-fluoroethane, from about 0.5 to about 39.5 weight percent of 1,2-dichloro-1,2,2-trifluoroethane, and from about 0.01 to about 0.5 weight percent nitromethane.

Even more preferably, the azeotrope-like compositions of the invention comprise from about 70 to about 99.5 Weight percent of 1,1-dichloro-1-fluoroethane, from about 0.5 to about 29.5 Weight percent of 1,2-dichloro-1,2,2-trifluoroethane, and from about 0.01 to about 0.5 weight percent nitromethane.

Most preferably, the azeotrope-like compositions of the invention comprise from about 85 to about 99.5 weight percent of 1,1-dichloro-1-fluoroethane, from about 0.5 to about 14.7 weight percent of 1,2-dichloro-1,2,2-trifluoroethane, and from about 0.01 to about 0.5 weight percent nitromethane.

Also, novel azeotrope-like compositions comprise 1,1-dichloro-1-fluoroethane; a mixture of 1,1-dichloro-2,2,2-trifluoroethane and 1,2-dichloro-1,2,2-trifluoroethane; and nitromethane which boil at about 31.9° C.±about 0.7° C. at 760 mm Hg (101 kpa).

More specifically, novel azeotrope-like compositions comprise from about 10 to about 99.5 weight percent of 1,1-dichloro-1-fluoroethane, from about 0.5 to about 89.5 weight percent of a mixture of 1,1-dichloro-2,2,2-trifluoroethane and 1,2-dichloro-1,2,2-trifluoroethane, and from about 0.01 to about 0.5 weight percent nitromethane which boil at about 31.9° C. at 760 mm Hg (101 kpa).

Preferably, novel azeotrope-like compositions comprise from about 25 to about 99.5 weight percent of 1,1-dichloro-1-fluoroethane, from about 0.5 to about 74.5 weight percent of a mixture of 1,1-dichloro-2,2,2-trifluoroethane and 1,2-dichloro-1,2,2-trifluoroethane, and from about 0.01 to about 0.5 weight percent nitromethane.

More preferably, novel azeotrope-like compositions comprise from about 50 to about 99.5 weight percent of 1,1-dichloro-1-fluoroethane, from about 0.5 to about 49.5 weight percent of a mixture of 1,1-dichloro-2,2,2-trifluoroethane and 1,2-dichloro-1,2,2-trifluoroethane, and from about 0.01 to 0.5 weight percent nitromethane.

Even more preferably, the azeotrope-like compositions of the invention comprise from about 60 to about 99.5 weight percent of 1,1-dichloro-1-fluoroethane, from about 0.5 to about 40 weight percent of a mixture of 1,1-dichloro-2,2,2-trifluoroethane and 1,2-dichloro-1,2,2-trifluoroethane, and from about 0.01 to about 0.5 weight percent nitromethane.

Even more preferably, the azeotrope-like compositions of the invention comprise from about 70 to about 99.5 weight percent of 1,1-dichloro-1-fluoroethane, from about 0.5 to about 30 weight percent of a mixture of 1,1-dichloro-2,2,2-trifluoroethane and 1,2-dichloro-1,2,2-trifluoroethane, and from about 0.01 to about 0.5 weight percent nitromethane.

Most preferably, the azeotrope-like compositions of the invention comprise from about 85 to about 99.5 weight percent of 1,1-dichloro-1-fluoroethane, from about 0.5 to about 15 weight percent of a mixture of 1,1-dichloro-2,2,2-trifluoroethane and 1,2-dichloro-1,2,2-trifluoroethane, and from about 0.01 to about 0.5 weight percent nitromethane.

Although it is not believed that a true azeotropic system is formed with 1,1-dichloro-1-fluoroethane. dichlorotrifluoroethane, and nitromethane, the term "azeotrope-like" is used herein for the mixtures of the invention because in the claimed proportions, the composition of 1,1-dichloro-1-fluoroethane, dichlorotrifluoroethane, and nitromethane components are constant-boiling or essentially constant-boiling and for some reason, which is not fully understood, remain or hang together in a vapor degreaser.

As previously noted, the preferred dichlorotrifluoroethane component is "commercial HCFC-123".

The azeotrope-like compositions of the invention containing a mixture of HCFC-123 and HCFC-123a are azeotrope-like in that they are constant-boiling or essentially constant-boiling. It is not known whether this is the case because the separate ternary azeotrope-like compositions with HCFC-123 and HCFC-123a have boiling points so close to one another as to be indistinguishable for practical purposes or whether HCFC-123 and HCFC-123a form a quaternary azeotrope-like composition with 1,1-dichloro-1-fluoroethane and nitromethane.

All compositions within the indicated ranges, as well as certain compositions outside the indicated ranges, are azeotrope-like, as defined more particularly below.

It has been found that these azeotrope-like compositions are on the whole nonflammable liquids, i.e. exhibit no flash point when tested by the Tag Open Cup test method - ASTM D 1310-86.

From fundamental principles, the thermodynamic state of a fluid is defined by four variables: pressure, temperature, liquid composition and vapor composition, or P-T-X-Y, respectively. An azeotrope is a unique characteristic of a system of two or more components where X and Y are equal at the stated p and T. In practice, this means that the components of a mixture cannot be separated during distillation, and therefore are useful in vapor phase solvent cleaning as described above.

For the purpose of this discussion, azeotrope-like composition is intended to mean that the composition behaves like an azeotrope, i.e. has constant-boiling characteristics or a tendency not to fractionate upon boiling or evaporation. Thus, in such compositions, the composition of the vapor formed during boiling or evaporation is identical or substantially identical to the original liquid composition. Hence, during boiling or evaporation, the liquid composition, if it changes at all, changes only to a minimal or negligible extent. This is to be contrasted with non-azeotrope-like compositions in which during boiling or evaporation, the liquid composition changes to a substantial degree.

Thus, one way to determine whether a candidate mixture is "azeotrope-like" within the meaning of this invention, is to distill a sample thereof under conditions (i.e. resolution - number of plates) which would be expected to separate the mixture into its separate components. If the mixture is non-azeotrope-like, the mixture will fractionate, i.e. separate into its various components with the lowest boiling component distilling off first, and so on. If the mixture is azeotrope-like, some finite amount of a first distillation cut will be obtained which contains all of the mixture components and which is constant-boiling or behaves as a single substance. This phenomenon cannot occur if the mixture is not azeotrope-like, i.e. it does not behave like an azeotrope. Of course, upon distillation of an azeotrope-like composition such as in a vapor degreaser, the true azeotrope will form and tend to concentrate.

It follows from the above that another characteristic of azeotrope-like compositions is that there is a range of compositions containing the same components in varying proportions which are azeotrope-like or constant-boiling. All such compositions are intended to be covered by the term azeotrope-like or constant-boiling as used herein. As an example, it is well known that at differing pressures, the composition of a given azeotrope-like composition will vary at least slightly as does the boiling point of the composition. Thus, an azeotrope-like composition of A and B represents a unique type of relationship but with a variable composition depending on temperature and/or pressure. As is readily understood by persons skilled in the art, the boiling point of the azeotrope-like composition will vary with the pressure.

The azeotrope-like compositions of the invention are useful as and solvents in a variety of vapor degreasing, cold cleaning and solvent cleaning applications including defluxing.

In one process embodiment of the invention, the azeotrope-like compositions of the invention may be used to clean solid surfaces by treating said surfaces with said compositions in any manner well known to the art such as by dipping or spraying or use of conventional degreasing apparatus.

The 1-fluoro-1,1-dichloroethane; dichlorotrifluoroethane; and nitromethane components of the novel solvent azeotrope-like compositions of the invention are known materials, preferably, except for "commercial HCFC-123" and its impurities, the materials should be used in sufficiently high purity so as to avoid the introduction of adverse influences upon the desired properties or constant boiling properties of the system.

It should be understood that the present compositions may include additional components so as to form new azeotrope-like or constant-boiling compositions. Any such compositions are considered to be within the scope of the present invention as long as the compositions are constant-boiling or essentially constant-boiling and contain all of the essential components described herein.

The present invention is more fully illustrated by the following non-limiting Examples.

EXAMPLE 1

To illustrate the constant-boiling nature of the mixtures of this invention under conditions of actual use in a vapor phase degreasing operation, a vapor phase degreasing machine was charged with a preferred mixture in accordance with the invention, comprising about 94.8 weight percent of HCFC-141b, about 4.9 weight percent of commercially available ultra-pure HCFC-123. and 0.3 weight percent nitromethane. The mixture was evaluated for its constant boiling or non-segregating characteristics. The vapor phase degreasing machine utilized was a small water-cooled, three-sump vapor phase degreaser which represents a type of system configuration comparable to machine types in the field today which would present the most rigorous test of solvent segregating behavior. Specifically, the degreaser employed to demonstrate the invention contained two overflowing rinse-sumps and a boil-sump. The boil-sump was electrically heated, and contained a low-level shut-off switch. Solvent vapors in the degreaser were condensed on water-cooled stainless-steel coils. Condensate from the boil-sump was returned to the first rinse-sump, also by gravity. The capacity of the unit was approximately 1.5 gallons. This degreaser was very similar to Baron Blakeslee 2 LLV 3-sump degreasers which are quite commonly used in commercial establishments.

The solvent charge was brought to reflux and the compositions in the condensate sump containing the clear condensate from the boil-sump, the work sump containing the overflow from the condensate sump, the boil sump where the overflow from the work sump is brought to the mixture boiling points were determined with a Perkin Elmer 8500 gas chromatograph. The temperature of the liquid in all the sumps was monitored with thermocouple temperature sensing devices accurate to ±0.2° C. Refluxing was continued for about 48 hours and boil and condensate sump compositions were monitored throughout this time. A mixture was considered constant-boiling or non-segregating if the maximum concentration difference between sumps for any mixture component was ±2 sigma around the mean value. Sigma is a standard deviation unit and it is our experience from many observations of vapor degreaser performance that commercial "azeotrope-like" vapor phase degreasing solvents exhibit at least a ±2 sigma variation in composition with time and yet produce very satisfactory non-segregating cleaning behavior.

If the mixture were not azeotrope-like, the high boiling components would very quickly concentrate in the still and be depleted in the rinse sump. This did not happen. Also, the concentration of each component in the sumps stayed well within ±2 sigma. These results indicate that the compositions of this invention will not segregate in any type of large-scale commercial vapor degreasers, thereby avoiding potential safety, performance, and handling problems. The preferred composition tested was also found to not have a flash point according to recommended procedure ASTM D 1310-86 (Tag Open Cup). The compositions in the sumps are shown in Table I below.

TABLE I

Degreaser Composition Stability Study

| Condensate Sump | Initial Composition | 24 hour | 48 hour |
|---|---|---|---|
| HCFC-141b | 94.8 | 93.2 | 94.7 |
| HCFC-123 | 4.9 | 6.7 | 5.2 |
| Nitromethane | 0.3 | 0.1 | 0.1 |
| Temperature (°C.) | | 21.3 | 22.1 |
| Barometric Pressure (mm of Hg)(kPa) | | 742.3 (99) | 746.3 (99) |
| **Boil Sump** | **Initial Composition** | **24 hour** | **48 hour** |
| HCFC-141b | 94.8 | 94.8 | 94.7 |
| HCFC-123 | 4.9 | 4.2 | 4.3 |
| Nitromethane | 0.3 | 1.0 | 1.0 |
| Temperature (°C.) | | 32.1 | 33.1 |
| Barometric Pressure (mm of Hg)(kPa) | | 742.3 (99) | 746.3 (99) |

EXAMPLE 2

Example 1 is repeated with a mixture of HCFC-141b, HCFC-123, and nitromethane where different proportions of the components were used. Again very slight segregation of the components in the sumps was observed. This confirms the wide range of compositions of the components over which the blend behaves azeotropic-like. The compositions in the sumps are shown in Table II below.

TABLE II

Degreaser Composition Stability Study

| Initial Condensate Sump | Initial Composition | 24 hour | 48 hour |
|---|---|---|---|
| HCFC-141b | 70.9 | 68.1 | 70.2 |
| HCFC-123 | 28.6 | 31.8 | 29.7 |
| Nitromethane | 0.5 | 0.1 | 0.9 |
| Temperature (°C.) | | 22.8 | 22.6 |
| Barometric Pressure (mm of Hg)(kPa) | | 742.3 (99) | 746.2 (99) |
| **Boil Sump** | **Initial Composition** | **24 hour** | **48 hour** |
| HCFC-141b | 70.9 | 70.8 | 72.6 |
| HCFC-123 | 28.6 | 28.0 | 26.3 |
| Nitromethane | 0.5 | 1.2 | 1.1 |
| Temperature (°C.) | | 31.6 | 31.7 |
| Barometric Pressure (mm of Hg)(kPa) | | 742.3 (99) | 746.2 (99) |

EXAMPLE 3

Example 1 is repeated except that a mixture of HCFC-141b, HCFC-123a, and nitromethane is used.

EXAMPLE 4

Example 1 is repeated except that a mixture of HCFC-141b, HCFC-123, HCFC-123a, and nitromethane is used.

Having described the invention in detail and by reference to preferred embodiments thereof, it will be apparent that modifications and variations are possible without departing from the scope of the invention defined in the appended claims.

What is claimed is:

1. Azeotrope-like compositions consisting essentially of from about 25 to about 99.5 weight percent 1,1-dichloro-1-fluoroethane, from about 0.5 to about 74.5 weight percent 1,1-dichloro-2,2,2-trifluoroethane, and from about 0.01 to about 0.5 weight percent nitromethane wherein said azeotrope-like components consist of said 1,1-dichloro-1-fluoroethane, said 1,1-dichloro-2,2,2-trifluoroethane, and said nitromethane and said azeotrope-like compositions boil at about 31.8° C. at 760 mm Hg.

2. The azeotrope-like compositions of claim 1 consisting essentially of from about 50 to about 99.5 weight percent said 1,1-dichloro-1-fluoroethane, from about 0.5 to about 49.5 weight percent said 1,1-dichloro-2,2,2-trifluoroethane, and from about 0.01 to about 0.5 weight percent said nitromethane.

3. The azeotrope-like compositions of claim 1 consisting essentially of from about 60 to about 99.5 weight percent said 1,1-dichloro-1-fluoroethane, from about 0.5 to about 39.5 weight percent said 1,1-dichloro-2,2,2-trifluoroethane, and from about 0.01 to about 0.5 weight percent said nitromethane.

4. The azeotrope-like compositions of claim 1 consisting essentially of from about 65 to about 99.5 weight percent said 1,1-dichloro-1-fluoroethane, from about 0.5 to about 34.5 weight percent said 1,1-dichloro-2,2,2-trifluoroethane, and from about 0.01 to about 0.5 weight percent said nitromethane.

5. The azeotrope-like compositions of claim 1 consisting essentially of from about 85 to about 99.5 weight percent said 1,1-dichloro-1-fluoroethane, from about 0.5 to about 14.7 weight percent said 1,1-dichloro-2,2,2-trifluoroethane, and from about 0.01 to about 0.3 weight percent said nitromethane.

6. Azeotrope-like compositions consisting essentially of from about 25 to about 99.5 weight percent 1,1-dichloro-1-fluoroethane, from about 0.5 to about 74.5 weight percent 1,2-dichloro-1,2,2-trifluoroethane, and from about 0.01 to about 0.5 weight percent nitromethane wherein said azeotrope-like components consist of said 1,1-dichloro-1-fluoroethane, said 1,2-dichloro-1,2,2-trifluoroethane, and said nitromethane and said azeotrope-like compositions boil at about 32.0° C. at 760 mm Hg.

7. The azeotrope-like compositions of claim 6 consisting essentially of from about 50 to about 99.5 weight percent said 1,1-dichloro-1-fluoroethane, from about 0.5 to about 49.5 weight percent said 1,2-dichloro-1,2,2-trifluoroethane, and from about 0.01 to about 0.5 weight percent said nitromethane.

8. The azeotrope-like compositions of claim 6 consisting essentially of from about 60 to about 99.5 weight percent said 1,1-dichloro-1-fluoroethane, from about 0.5 to about 39.5 weight percent said 1,2-dichloro-1,2,2-trifluoroethane, and from about 0.01 to about 0.5 weight percent said nitromethane.

9. The azeotrope-like compositions of claim 6 consisting essentially of from about 70 to about 99.5 weight percent said 1,1-dichloro-1-fluoroethane, from about 0.5 to about 29.5 weight percent said 1,2-dichloro-1,2,2-trifluoroethane, and from about 0.01 to about 0.5 weight percent said nitromethane.

10. The azeotrope-like compositions of claim 6 consisting essentially of from about 85 to about 99.5 weight percent said 1,1-dichloro-1-fluoroethane, from about 0.5 to about 14.7 weight percent said 1,2-dichloro-1,2,2-trifluoroethane, and from about 0.01 to about 0.5 weight percent said nitromethane.

11. Azeotrope-like compositions consisting essentially of from about 10 to about 99.5 weight percent of 1,1-dichloro-1-fluoroethane, from about 0.5 to about 89.5 weight percent of a mixture of 1,1-dichloro-2,2,2-trifuloroethane and 1,2-dichloro-1,2,2-trifluoroethane, and from about 0.01 to about 0.5 weight percent nitromethane wherein said azeotrope-like components consist of said 1,1-dichloro-1-fluoroethane, said mixture of said 1,1-dichloro-2,2,2-trifluoroethane and said 1,2-dichloro-1,2,2-trifluoroethane, and said nitromethane and said azeotrope-like compositions boil at about 31.9° C. at 760 mm Hg.

12. The azeotrope-like compositions of claim 11 consisting essentially of from about 25 to about 99.5 weight percent said 1,1-dichloro-1-fluoroethane, from about 0.5 to about 74.5 weight percent said mixture, and from about 0.01 to about 0.5 weight percent said nitromethane.

13. The azeotrope-like compositions of claim 11 wherein said mixture is about 90 to about 95 weight percent said 1,1-dichloro-2,2,2-trifluoroethane and about 5 to about 10 weight percent said 1,2-dichloro-1,2,2-trifluoroethane.

14. The azeotrope-like compositions of claim 11 wherein said mixture is about 95 to about 99.5 weight percent said 1,1-dichloro-2,2,2-trifluoroethane and about 0.5 to about 5 weight percent said 1,2-dichloro-1,2,2-trifluoroethane.

15. The azeotrope-like compositions of claim 11 consisting essentially of from about 50 to about 99.5 weight percent said 1,1-dichloro-1-fluoroethane, from about 0.5 to about 49.5 weight percent said mixture, and from about 0.01 to about 0.5 weight percent said nitromethane.

16. The azeotrope-like compositions of claim 11 consisting essentially of from about 60 to about 99.5 weight percent said 1,1-dichloro-1-fluoroethane, from about 0.5 to about 40 weight percent said mixture, and from about 0.01 to about 0.5 weight percent said nitromethane.

17. The azeotrope-like compositions of claim 11 consisting essentially of from about 70 to about 99.5 weight percent said 1,1-dichloro-1-fluoroethane, from about 0.5 to about 30 weight percent said mixture, and from about 0.01 to about 0.5 weight percent said nitromethane.

18. The azeotrope-like compositions of claim 7 consisting essentially of from about 85 to about 99.5 weight percent said 1,1-dichloro-1-fluoroethane, from about 0.5 to about 15 weight percent said mixture, and from about 0.01 to about 0.5 weight percent said nitromethane.

19. A method of cleaning a solid surface which comprises treating said surface with said azeotrope-like composition as defined in claim 1.

20. A method of cleaning a solid surface which comprises treating said surface with said azeotrope-like composition as defined in claim 6.

* * * * *